United States Patent [19]

Barbour et al.

[11] 4,078,878

[45] Mar. 14, 1978

[54] FUEL BURNER CONTROL DEVICE PROVIDING SAFELY IGNITED BURNER

[75] Inventors: Stacy O. Barbour, Minnetonka; William B. Hamelink, Richfield, both of Minn.

[73] Assignee: Honeywell Inc., Minneapolis, Minn.

[21] Appl. No.: 683,449

[22] Filed: May 5, 1976

[51] Int. Cl.[2] ..... F23N 5/24

[52] U.S. Cl. ..... 431/22; 431/16; 431/30

[58] Field of Search ..... 431/22, 5, 6, 67, 66, 431/78, 79, 30, 45, 16; 236/15 BD, 15 BG

[56] References Cited

U.S. PATENT DOCUMENTS

| | | | |
|---|---|---|---|
| 2,964,102 | 12/1960 | Cassell et al. | 431/30 |
| 3,024,835 | 3/1962 | Ryder | 431/63 X |
| 3,086,583 | 4/1963 | Reichow | 431/22 |
| 3,410,310 | 11/1968 | Ray | 431/30 X |
| 3,482,922 | 12/1969 | Blackett | 431/79 X |
| 3,744,954 | 7/1973 | Faulkner | 431/22 X |
| 3,840,322 | 10/1974 | Cade | 431/78 |
| 4,035,134 | 7/1977 | Matthews | 431/22 X |

*Primary Examiner*—William P. O'Dea
*Assistant Examiner*—Larry Jones
*Attorney, Agent, or Firm*—Alfred N. Feldman

[57] ABSTRACT

A sequencing and monitoring control device for fuel burners is provided having a unique burner program. The fuel burner is put into operation with an ignition means turned on, along with fuel pressure and combustion air, but without fuel being intentionally introduced into the combustion chamber. This start-up procedure would ignite any leakage fuel. The ignition is ended and an attempt is made to sense whether a flame exists thereby indicating the presence of leakage fuel. If any flame exists, the system shuts down on safety. If none exists, the sequence proceeds to a preselected burner sequence.

10 Claims, 7 Drawing Figures

FUEL BURNER CONTROL DEVICE PROVIDING SAFELY IGNITED BURNER

BACKGROUND OF THE INVENTION

Large sized fuel burners used in commercial and industrial buildings, as well as, in process control have for many years utilized progammers that operate primarily by using motor driven cam operated switches and electromagnetic relays to provide the necessary logic and sequence for safe burner operation. Most of the programmers on the market were designed for the ignition of either gas burners, or of gas burners which subsequently were augmented by the addition of fuel oil. Most burners which operate directly on oil utilize spark ignition of the fuel oil substantially immediately upon the energization of the burner. Since the advent of the fuel shortage, and due to changes in general economic considerations in fuel burners, the oil burner has become more important. Large oil burners have substantially different characteristics than gas burners, and require a different sequence for their initiation if safety is to be properly provided for. Most gas burners utilize a prepurge period to clear the combustion chamber of unburned products before the initiation of the burner cycle. This is not necessarily true of oil burners, and the use of a prepurge in a oil burner can create an unsafe condition by oil pressure forcing oil into the combustion chamber past a leaky oil valve and result in the accumulation of a dangerous amount of fuel in the combustion chamber.

The special needs of oil burners, versus gas burners, is becoming more and more apparent and the provision of special equipment for oil burners for safe operation has become necessary. A programmed sequence for safe start-up of a gas burner may not be a safe sequence for start-up of an oil burner. The need of a special sequence for oil burners has thus become apparent.

SUMMARY OF THE INVENTION

The present invention is directed to a unique sequence for a fuel burner, and more particularly a fuel burner of the type that burns fuel oil or a similar type of liquid fuel as opposed to a gaseous fuel. Fuel burners that utilize liquid fuel such as fuel oil, normally include a pump and a blower which supply the fuel pressure and combustion air. The combustion air is normally allowed to flow through the combustion chamber, but the fuel oil is held out of the combustion chamber until an ignition device, normally an ignition transformer with spark electrodes, has established a stable ignition source or spark. Fuel valves which are operated under the pressures of modern day fuel oil burners quite commonly have a leakage problem with the oil leaking into the combustion chamber prior to the establishment of a safe ignition spark. The present invention provides for a particular cycle of operation of a fuel burner which will detect leakage oil and will shut down the system in a safe manner.

Basically the present invention is directed to the concept of starting the fuel oil pump and blower for combustion air, and substantially simultaneously turning on an ignition source such as an ignition transformer having spark electrodes. The fuel oil valve is kept closed while the ignition source attempts to light any fuel in the fuel burner that might have leaked past the fuel oil valve. If any leakage does occur, flame is brought about with a relatively small amount of fuel present and is detected by a flame sensor and safety circuit which then shuts down the system and locks the system out requiring manual restart after the leakage problem has been corrected. In the event that no leakage has occurred and the flame sensor does not detect a flame when none should be present, the sequence is continued with the ignition transformer being energized to provide a spark that is allowed time to become stable before the first stage oil valve or pilot oil valve is opened. After the first stage oil valve is opened and a flame should be present, the same flame sensor and monitoring system monitors for the presence of flame and will shut the system down in a safe manner if flame is not detected.

The present invention provides a fuel burner control device utilizing a programmer that has a sequence and monitoring mode not heretofore available for use with burners such as oil burners.

DESCRIPTION OF THE PREFERRED EMBODIMENTS

Figure 1:
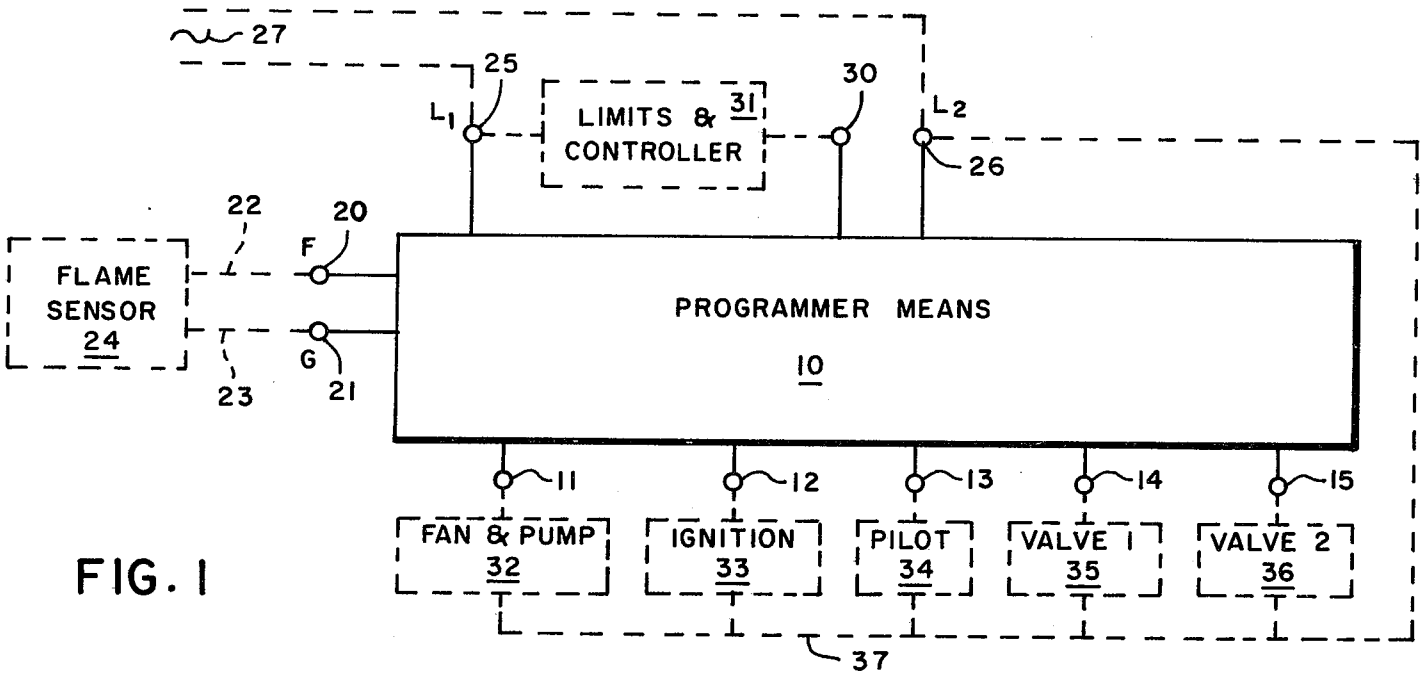
FIG. 1 is a block diagram of a fuel burner control device which utilizes ignition, pilot and fuel valves, as well as the necessary flame sensor and input controls.

In FIG. 1 there is disclosed a programming means 10 which includes a sequencing means for controlling electric circuit means to a plurality of output terminal means 11, 12, 13, 14 and 15. The programming means has a pair of input terminals 20 and 21 which are the flame and ground terminals which are adapted to be connected by conductors 22 and 23 to a flame sensor means 24. A further pair of input terminals 25 and 26 are provided for the programming means 10 and are connected as the line terminals to supply an alternating current 27 to the burner control device in general. A further input terminal 30 is provided which allows for the connection of various limits and controller 31 which are conventional in fuel burner control systems.

While the description of the system in the present disclosure is generally to fuel burners, it should be understood that the most common fuel burner would be an oil burner and that the terms generally can be considered as synonymous. The programmer means 10 has its output terminal 11 connected to a fan and pump disclosed at 32. The output terminal 12 is connected to ignition means 33 which normally would be an ignition transformer and would further include ignition electrodes so that a spark could be generated to provide ignition of the fuel issuing into the burner. The output terminal means 13 is connected to a pilot valve 34, while the output terminals 14 and 15 are connected to two stages of oil valves 35 and 36. The fan and pump 32, the ignition means 33, the pilot valve 34, and the oil valves 35 and 36 are all connected by a common conductor 37 to the terminal 26. Electric energy supplied to the terminal 25 flows (in a sequence controlled manner) through the programming means 10 to the terminals 11 through 15 to energize the components 32, 33, 34, 35 or 36.

To this point, the elements of a conventional fuel or oil burner have been disclosed including the necessary programming means and the various elements that either supply an input signal to the programming means 10 or are controlled as an output from the programmer means 10. The invention of the present application is directed to the specific sequence in which these elements are utilized. The internal circuitry of the programmer means 10 is disclosed in complete detail in FIG. 7 and will be referred to very briefly at the close of the description of the function of the programmer means 10. The specific circuitry contained in the programmer means 10 could be varied extensively and is not directly material to the present invention. The present invention is contained in the specific sequence delivered by the programmer means 10.

Figure 2:
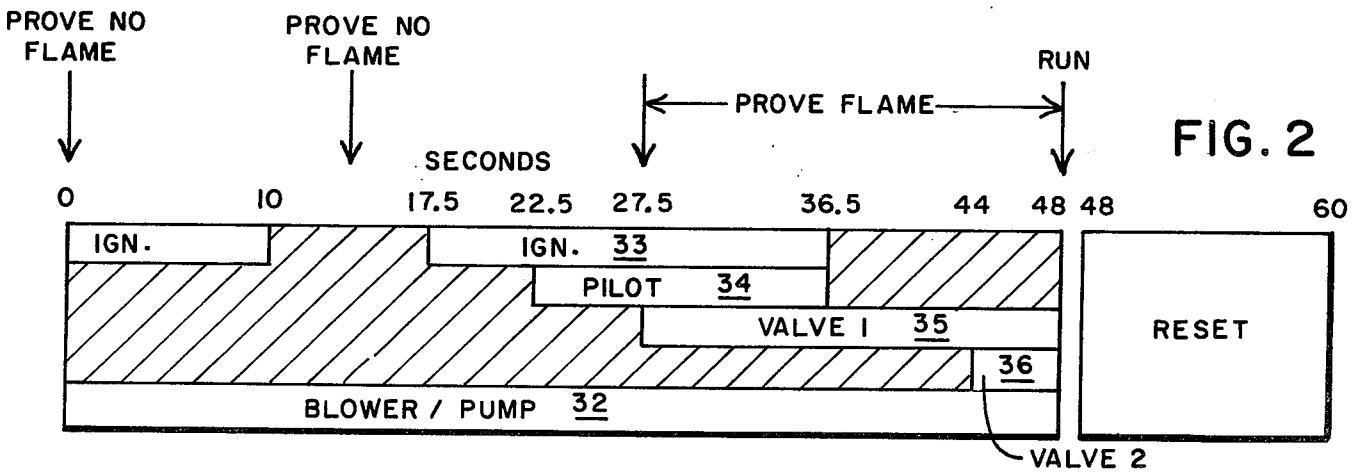
FIG. 2 is a bar chart of the operation of the burner control device of FIG. 1.

In FIG. 2 a first sequence of operation of programmer means 10 is disclosed in the form of a bar chart. The bar chart is a chart of the sequence of operation of the elements connected to the terminals 11 through 15 versus time. It should be understood that while the bar chart disclosed in FIG. 2 starts with a time of 0, that a prepurge period could precede the 0 time if that became necessary or desirable, but the present disclosure does not disclose a prepurge period in which nothing more than air is caused to flow through the fuel burner to remove any unburnt fuels that are in vapor form for safety of ignition and operation of the fuel burner. In such a case the oil source would not be pressurized during the prepurge and the pilot might be gas.

In the bar chart of FIG. 2 at the time 0, the ignition means 33 and the fan and pump means 32 are caused to be energized by the programmer means 10. While the bar chart discloses the ignition means 33 being simultaneously energized with the fan and pump means 32, their start times could be varied from one another by some small interval of time even though the preferred embodiments discloses that they occur simultaneously. It will be noted that the fan and pump means 32 is energized continuously from the 0 start time to the 48 second interval at which time the burner would be in a normal run condition. The run condition is when the programmer means 10 has caused the fuel burner to be ignited and put into operation with all of the connected fuel valves in an energized state. The run time is an indeterminate period of time based on either a device, such as a thermostat, or a process controller and is generally well understood in the burner art.

At approximately 10 seconds into the bar chart time, the ignition means 33 is deenergized by terminal 12 being disconnected from power by the programming means 10. If for any reason fuel has leaked into the combustion chamber of the fuel burner with the fan and pump running, the fuel would be ignited and would be sensed by the flame sensor 24. If flame is sensed by flame sensor 24 at a predetermined time interval between the 10 second point and 17.5 seconds, a safety switch means would be actuated by the flame sensor 24 providing a signal to the programmer means 10 and its internally contained electric circuit means. In the event that flame is detected at this point in time, the device locks out and requires a manual reset of the safety switch before a restart can be attempted. This, of course, brings to the attention of service personnel the need for a determination of why fuel had leaked into the combustion chamber. If no flame is proved at the intermediate time between 10 seconds and 17.5 seconds, the programmer means 10 continues on to the 17.5 second period of time where the terminal 12 is again energized to bring on the ignition means 33. The ignition means 33 is allowed approximately 5 seconds to establish a clean spark that is stable. By allowing a time interval from the energization of the ignition means 33 certain benefits are derived. Since the ignition means 33 is generally a spark transformer and spark electrodes, the spark generated tends to clean any residual fuel on the electrodes, cleans any small amounts of carbon deposits, and establishes a stable spark that is capable of igniting the fuel that it to be introduced.

The programmer means 10 then continues the program until 22.5 seconds is reached, at which time the terminal 13 is energized to the pilot valve means 34 to introduce pilot fuel for ignition from the ignition means 33. Beginning at the 27.5 second interval and extending to the 48 second interval, the flame sensor 24 and its associated circuitry within the programmer means 10 monitors the burner and insures that a flame is present or the device will operate the safety switch means and will again lock out indicating a different type of failure than would have been indicated by a failure between the 10 and 17.5 second interval.

At the 27.5 second interval the first fuel valve 35 is energized by the programmer means 10 and opens to admit fuel which is ignited from the pilot and the ignition means 33. At 36.5 seconds, the ignition means 33 and the pilot valve 34 are turned off by the programmer means 10 and the fuel issuing from the fuel valve means 35 must continue to burn or the flame sensor 24 will sense the absence of flame and shut the burner down in a safe manner. The burning fuel from the fuel valve 35 ignites fuel issuing from a second fuel valve 36 at approximately 44 seconds and all of the fuel being introduced into the burner continues to burn from that point until the limits or controller closes down after the end of the run period at 48 seconds. The present bar chart discloses a 12 second reset period in which the cam operated switches and relays contained in the programmer means 10 reset themselves to 0 after the controller 31 opens to turn off the burner. This is a conventional reset arrangement and is not directly pertinent to the inventive concept contained in the particular program of the present invention.

Figure 3:
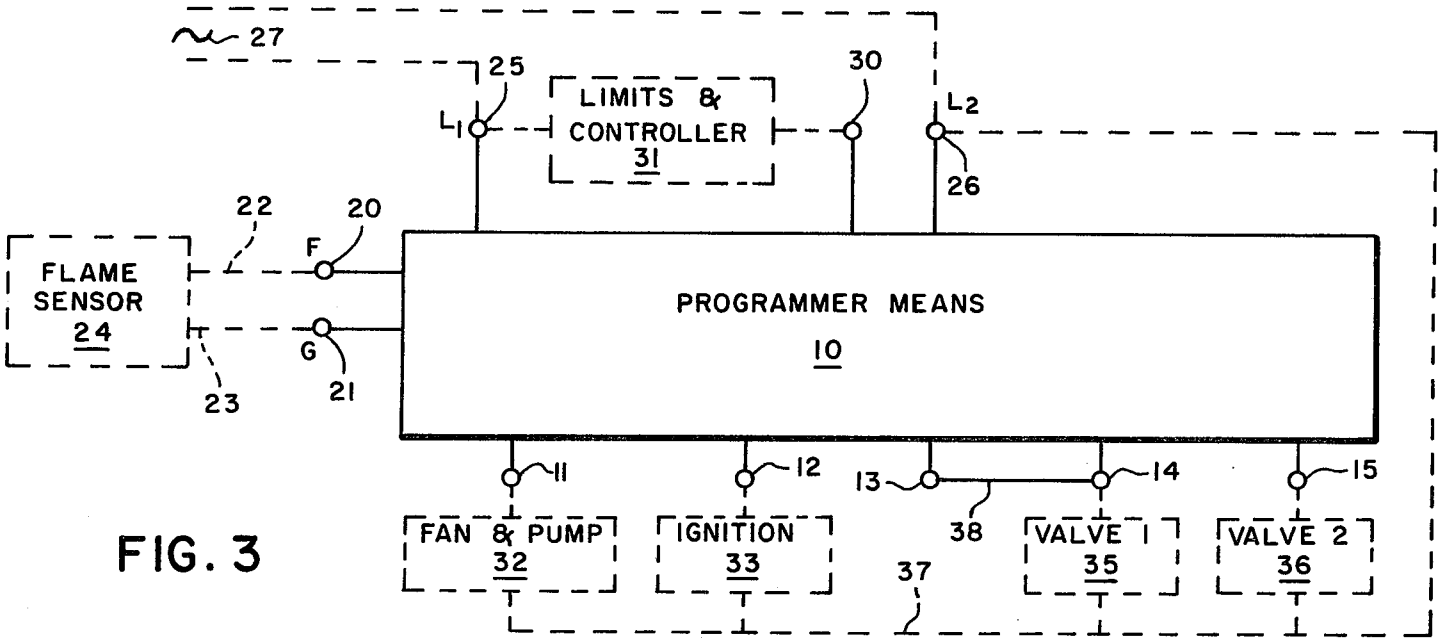
FIG. 3 is a block diagram of a fuel burner control device similar to FIG. 1 except the pilot has been replaced by a small first stage burner.

In FIG. 3 a fuel burner control device which is substantially the same as that of FIG. 1 is disclosed. The only difference is that the terminals 13 and 14 have been interconnected by a lead 38 and the pilot valve means 34 has been dispensed with. This can be done when the first stage of the burner is small and is controlled by the fuel valve 35. The first stage of the fuel burner thus acts not only as part of the fuel burner itself, but acts as the pilot for the system. All of the items of the balance of the disclosure of FIG. 3 correspond to that of FIG. 1 and will not be repeated.

Figure 4:
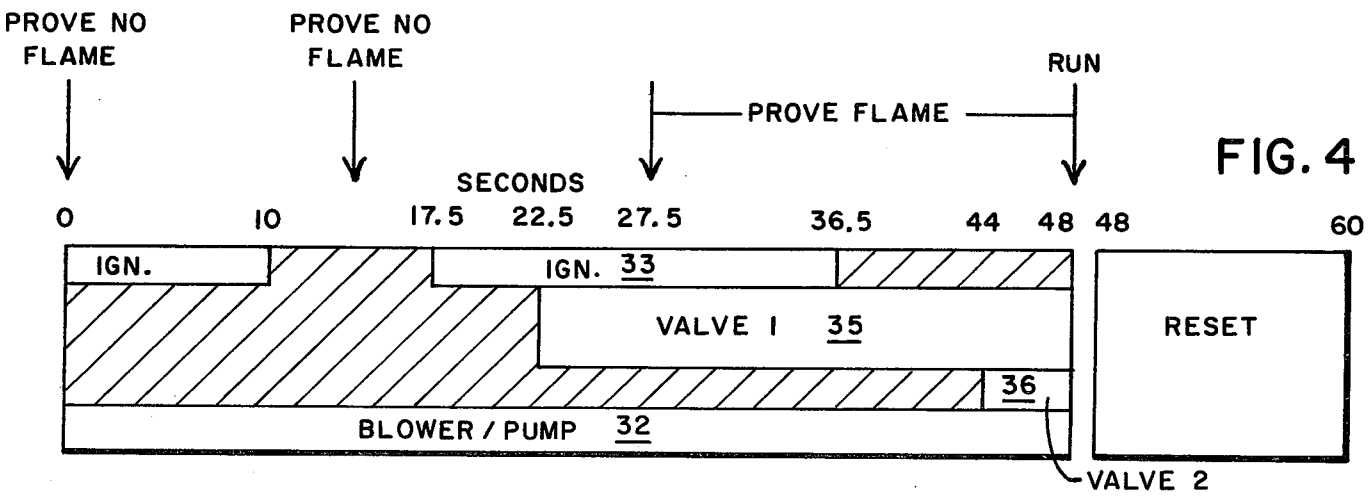
FIG. 4 is a bar chart of the operation of the control device of FIG. 3.

In FIG. 4 there is again provided a bar chart of the function of the fan and pump 32, the ignition means 33, the fuel valve 35, and the second stage fuel valve 36. It will be noted that the bar chart of FIG. 4 corresponds to the bar chart of FIG. 2 except that the pilot has been dispensed with, and that the first oil valve means 35 acts not only as a first stage of the burner, but acts also as the pilot for the device. Once again, the run period has been shown as an indeterminate time after the 48 second point and a reset period has been provided.

Figure 5:
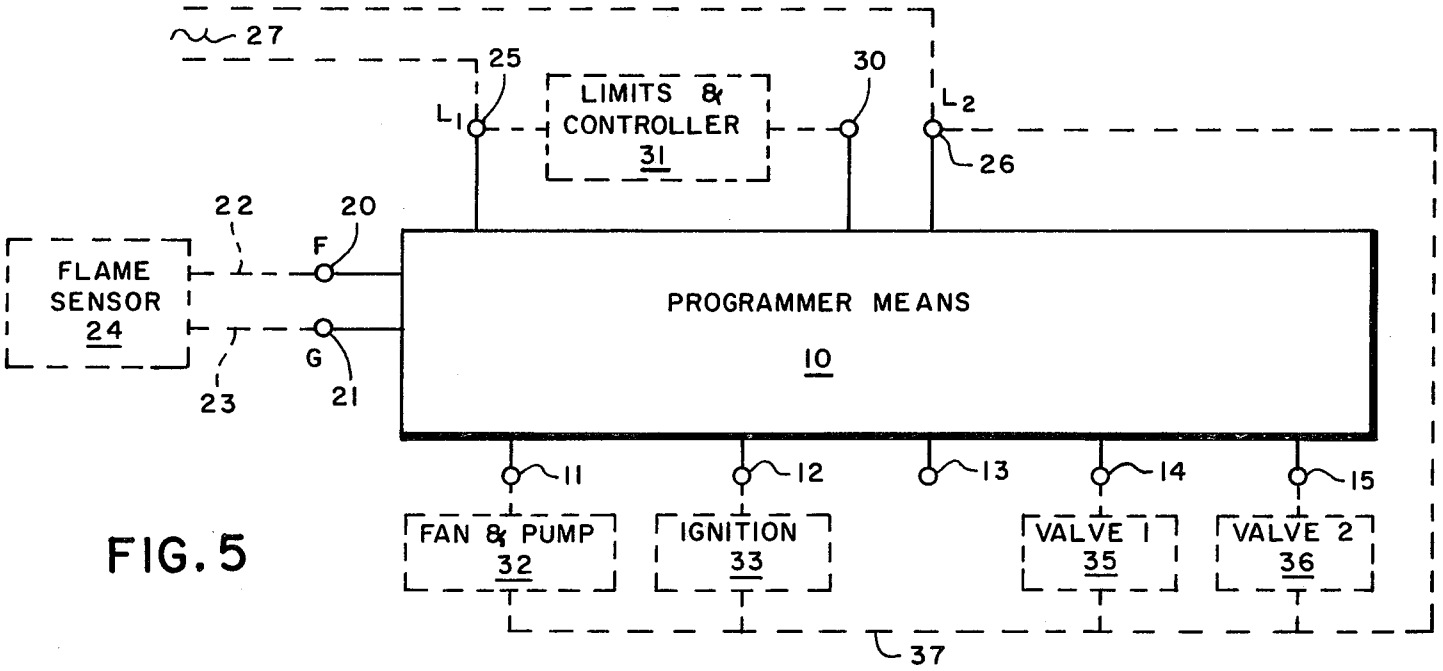
FIG. 5 is a block diagram of a control device similar to FIG. 1 except the pilot sequence has been removed.
Figure 6:
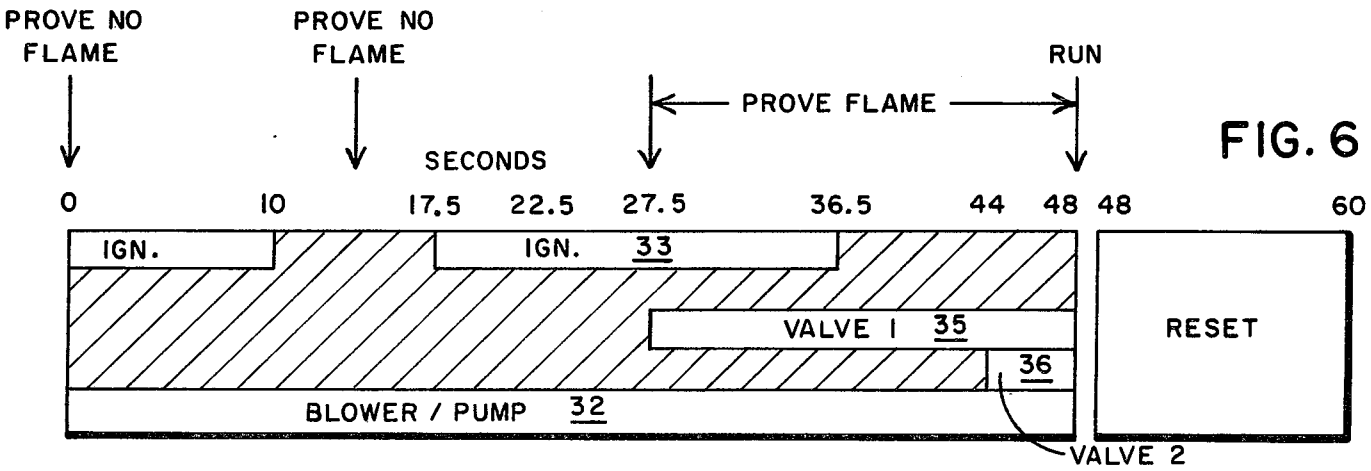
FIG. 6 is a bar chart of the operation of the control device of FIG. 5.

In FIG. 5 the programming means 10 along with all of the associated circuitry have been shown, but in this case the pilot valve has been dispensed with in its entirety. The first stage or the first oil valve 35 is provided without any connection between the terminal 13 and 14. In this particular case, the first stage oil valve 35 is brought on at 27.5 seconds as is disclosed in the bar chart of FIG. 6 and which overlaps the ignition period between 17.5 seconds and 36.5 seconds. This arrangement allows for the flame sensor 24 to prove the ignition source prior to the admission of fuel beginning at 27.5 seconds. Ignition or spark proving is thus proved if the proper sensor and amplifier are used. In this way, at all times when fuel is being introduced, the flame sensing system and safety switch means are active to safely shut down the system in the event that the fuel is not ignited and flame provided. The variation between the systems disclosed in the bar charts of FIG. 4 and FIG. 6 have been disclosed due to the variance between different types of burners that are currently on the market and which would utilize the fuel burner control device disclosed in the present invention. The start-up and monitoring concept of the present invention is incorporated in all three of the versions disclosed.

Figure 7:
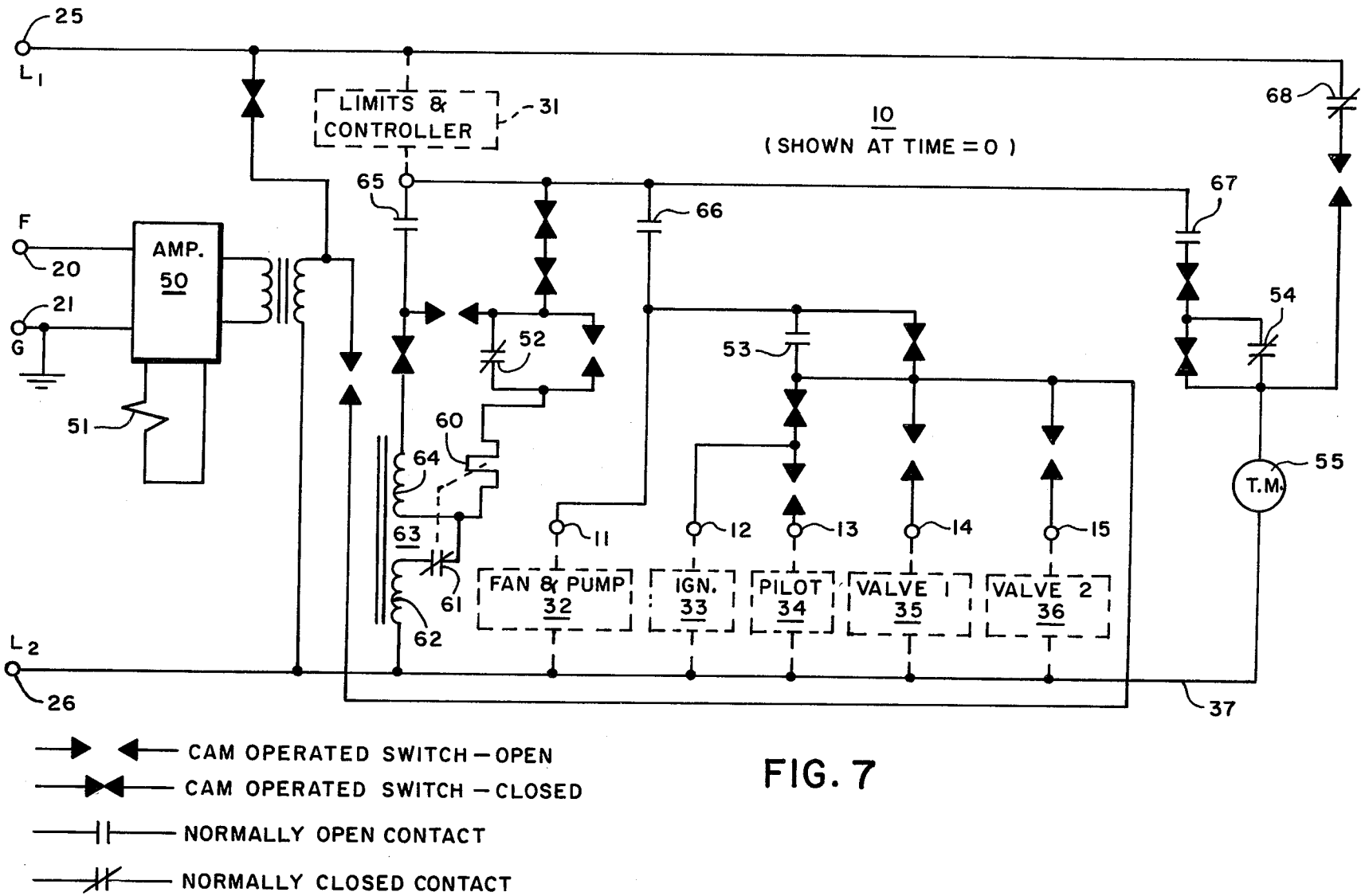
FIG. 7 is a schematic diagram of a typical circuit of the main block of FIGS. 1, 3 and 5.

In FIG. 7 a schematic diagram of the programmer means 10 has been provided along with the connection and terminals to the burner so that the internal details of the programmer means 10 can be shown in one typical configuration. This typical configuration in no way acts as a limitation on the internal structure of the programming means 10, as various programming configurations could be used. FIG. 7 is merely an example of one preferred programming configuration.

Terminals 20 and 21 which are connected to a flame sensor 24 are connected to an electronic amplifier means 50 which has as its output a flame relay means 51. The flame relay means 51 has three contacts. The first is a normally closed contact 52, the second is a normally opened contact 53, and the third is a normally closed contact 54. The contact 54 is shown shorted by a cam operated switch that is disclosed in its closed condition at time equals 0. The cam operated switches, as it indicated in the legend, are either opened or closed depending on the time into the program and their opening and closing is controlled by a motor driven cam mechanism 55. The cam operated switch arrangement including the mechanism 55 is a well-known type of cam operated programming arrangement used in the burner art and the operation of all of the cam operated switches and their time intervals will not be described in detail but relate to the bar charts of the earlier FIGS. 2, 4 and 6.

The programming means 10 as disclosed in FIG. 7 is at 0 time, and the limits and controller 31 upon closing completes a circuit through the normally closed flame relay contact 52 and a heating element 60 and a normally closed switch 61 which make up the safety switch means for the burner control device. The heater 60 operates on a bimetal element which causes the switch 61 to open and latch itself in an open condition requiring manual reset. This safety switch means is conventional in this particular type of programmer for fuel burners. It is noted that the circuit through the heater 60 and the normally closed switch 61 is completed to a winding 62 of a further relay 63 which has a holding winding 64 that subsequentially becomes energized. The relay 63 has four contacts 65, 66, 67 and 68. Only the contact 68 is normally closed while the contacts 65, 66 and 67 are normally open.

The programmer means 10 further is disclosed as having the terminals 11, 12, 13, 14 and 15 which are connected to the fan and pump 32, the ignition means 33, the pilot valve 35, the first fuel valve 35 and the second fuel valve 36. The common conductor 37 is again also disclosed to the line terminal 26. A further line terminal 25 is again shown and basically completes the circuitry of a conventional type of programmer means used in the burner control art.

While the programmer means used in the present fuel burner control device is fabricated along conventional lines, the particular sequence and monitoring arrangement for this programmer is unique in that the fan and pump 32 are energized along with the ignition means 33 at time O. The flame sensor 24 monitors for the absence of flame in the burner before the programmer means 10 is allowed to start. The ignition means 33 is than allowed to attempt to ignite any fuel that might have leaked into the fuel burner. Between the 10 second and 17.5 second intervals the sensor monitors for the existence of a flame when none should be present. If a flame is detected, the sytem will shut down in a safe manner. If no flame is present, the system is allowed to proceed to a normal start-up with the subsequent monitoring of the burning fuel by the flame sensor means 24. A flame failure will stop the burner on safety.

As can be seen the present invention can be carried out in a number of different modes, and the present invention is limited solely by the scope of the appended claims.

The embodiments of the invention in which an exclusive property or right is claimed are defined as follows:

1. A fuel burner control device to sequence and monitor the operation of a fuel burner, said burner including a fuel valve means, said device, including: programmer means having sequencing means for controlling electric circuit means to a plurality of output terminal means; said programmer means further including flame responsive circuit means including input terminals adapted to be connected to a flame sensor; said programmer means including safety switch means which is responsive to said electric circuit means and said flame responsive circuit means to operate to safely terminate said fuel burner operation during predetermined portions of the operation of said programmer means; said programmer means upon initiation thereof completing a circuit to first output terminal means adpated to energize fuel pressure and combustion air means for said fuel burner while keeping said fuel valve means closed, and completing a circuit to second output terminal means which is adpated to energize ignition means to ignite fuel at said fuel burner in the event that fuel is inadvertently present after the initiation of operation; said electric circuit means deenergizing said second output terminal means to turn off said ignition means while said flame sensor monitors said fuel burner for a flame when none should be present, and wherein the presence of a flame would operate said safety switch means; and said electric circuit means again energizing said second output terminal means and further circuit means to said output terminal means to energize said ignition means to operate said fuel burner in a preselected burner sequence which includes said safety switch means operating when said flame sensor fails to detect a flame at said fuel burner when flame should be present.

2. A fuel burner control device as described in claim 1 wherein said first and said second output terminal means are initially energized at substantially the same time.

3. A fuel burner control device as described in claim 2 wherein said safety switch means includes latching means which latches said safety switch means when said safety switch means is operated and thereafter requires manual reset.

4. A fuel burner control device as described in claim 1 wherein said programmer means includes cam operated switch means and electromagnetically operated relay means for controlling said electric circuit means to said output terminal means.

5. A fuel burner control device as described in claim 4 wherein said first and said second output terminal means are initially energized at substantially the same time.

6. A fuel burner control device as described in claim 5 wherein said safety switch means includes latching means which latches said safety switch means when said safety switch means is operated and thereafter requires manual reset.

7. A fuel burner control device as described in claim 6 wherein said further circuit means and said output terminal means are adapted to be connected to pilot valve means and fuel valve means to operate said fuel burner in said preselected burner sequence wherein said pilot valve means is opened to allow pilot fuel to ignite and to then open said fuel valve means to allow further fuel to ignite from said ignited pilot fuel.

8. A fuel burner control device as described in claim 7 wherein flame responsive circuit means is responsive to ultraviolet radiation at said flame sensor, and said ignition means includes a transformer connected to spark electrodes.

9. A fuel burner control device as described in claim 6 wherein said further circuit means and said output terminal means are adapted to be connected to said fuel valve means to operate said fuel burner in said preselected burner sequence wherein said fuel valve means is opened to allow fuel to ignite directly from said ignition means.

10. A fuel burner control device as described in claim 9 wherein said flame responsive means is responsive to ultraviolet radiation at said flame sensor, and said ignition means includes a transformer connected to spark electrodes.

* * * * *